US007852279B2

(12) United States Patent
Apostolos et al.

(10) Patent No.: US 7,852,279 B2
(45) Date of Patent: Dec. 14, 2010

(54) POLARIZATION-INDEPENDENT ANGLE OF ARRIVAL DETERMINATION SYSTEM USING A MINIATURE CONFORMAL ANTENNA

(75) Inventors: John T. Apostolos, Lyndborough, NH (US); Paul M. Degitz, Nashua, NH (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 259 days.

(21) Appl. No.: 12/152,387

(22) Filed: May 14, 2008

(65) Prior Publication Data

US 2008/0316131 A1 Dec. 25, 2008

Related U.S. Application Data

(60) Provisional application No. 60/937,117, filed on Jun. 25, 2007.

(51) Int. Cl.
*H01Q 21/26* (2006.01)

(52) U.S. Cl. ..... 343/789; 343/797

(58) Field of Classification Search ..... 343/700 MS, 343/789, 756, 895, 795, 797
See application file for complete search history.

(56) References Cited

U.S. PATENT DOCUMENTS 7,577,464 B2 * 8/2009 Ezal et al. ..... 455/562.1

* cited by examiner

*Primary Examiner*—Michael C Wimer
(74) *Attorney, Agent, or Firm*—Robert K. Tendler; Daniel J. Long

(57) ABSTRACT

A miniature conformal antenna is provided with a polarization-independent output by using quadrature elements at the mouth of a cavity and by processing the RHCP and LHCP outputs of the elements to arrive at a polarization-dependent solution; and then correcting the angle of arrival result by electronically rotating the antenna, measuring the amplitude difference between element pairs at various angles, generating an amplitude difference curve and deriving an angular correction factor therefrom.

11 Claims, 8 Drawing Sheets

Bearing (AOA) ≡ RHCP, LHCP

RHCP x LHCP = REF

LHCP - REF = Azimuthal Bearing

RHCP - REF = Azimuthal Bearing $$\frac{|\,RHCP\,| \times (RHCP\text{-}REF) - |\,LHCP\,| \times (LHCP\text{-}REF)}{[LHCP] + [RHCP]} = \text{Average Azimuthal Bearing Angle (Polarization Dependant)}$$

$$LHCP \times RHCP \Rightarrow REF$$

$$RHCP - REF = AOA\ (\text{Polarization DEP})$$

$$LHCP - REF = AOA\ (\text{Polarization DEP})$$

$$\frac{[RHCP] \times (RHCP - REF + \alpha+) - [LHCP] \times (LHCP - REF + \alpha-)}{[LHCP] + [RHCP]} = \overline{AOA}$$

AOA is polarization independent

*Fig. 8*

POLARIZATION-INDEPENDENT ANGLE OF ARRIVAL DETERMINATION SYSTEM USING A MINIATURE CONFORMAL ANTENNA

CROSS REFERENCE TO RELATED APPLICATION

This application claims rights under 35 USC §119(e) from U.S. Application Ser. No. 60/937,117 filed Jun. 25, 2007, the contents of which are incorporated herein by reference.

FIELD OF THE INVENTION

This invention relates to determination of angle of arrival of incoming signals and more particularly to a low visibility conformal antenna in which the angle of arrival determination is made independent of the polarization of the incoming signal though circular polarization measurements and electronic antenna rotation.

BACKGROUND OF THE INVENTION

Measuring the angle of arrival of incoming signals in the past has been accomplished through the utilization of Adcock antennas and the like which involve antennas that extend above the top of vehicles that increases the visibility of the vehicle, aircraft, or vessel.

There is therefore need to provide a conformal antenna from which angle of arrival of incoming signals can be determined, and to do so regardless of the polarization of the incoming signal. It is noted that it is possible to obtain the angle of arrival of an incoming signal with a high degree of accuracy, but this accuracy is degraded significantly if one does not know the polarization of the incoming signal. This is especially true when deriving angle of arrival from left hand circular polarized and right hand circular polarized components of the received signal. Thus, it is important to be able to ascertain the angle of arrival of an incoming signal independent of the polarization of the incoming wave.

While co-pending patent applications Orientation-Independent Antenna with Shorts (2006-0003), Ultra Compact UHF Satcom Antenna (2006-0005), and Orientation-Independent Antenna (2007-0058) assigned to the assignee hereof and incorporated herein by reference relate to orientation-independent antennas utilizing miniature volumetric quadrametric geometry, it is not entirely clear how these antennas can be configured for a direction finding function and be polarization independent. Moreover, how to preserve these direction finding functions when providing a miniature antenna conformal to a surface in which it is embedded presents some challenges.

Thus, while a Satcom version of the orientation-independent miniature antenna is described in the above identified co-pending patent applications, when attempts are made to embed these antennas in a cavity to make the antenna into a conformal antenna, how one obtains polarization independence to permit accurate angle of arrival measurements is unclear. This is because the complicated phasing used to make these antennas orientation-independent is not applicable to a conformal antenna used for polarization-independent direction finding.

SUMMARY OF INVENTION

A miniature cavity-embedded conformal antenna includes a cavity having quadrature antenna elements located at the top of the cavity. In one embodiment inwardly pointed triangular shaped elements are located at the mouth of the cavity. These elements have feed lines going from their apexes out through the bottom of the cavity to a processor. It has been found that one can take the four outputs of the elements and easily process them to obtain polarization-independent results. These results are in part due to the electronic rotation of the antenna and correction factors derived from the rotation.

Specifically, signals representing right hand circular polarization and left hand circular polarization are first multiplied together to derive a reference, with the phase difference between the right hand circular polarization or left hand circular polarization and the reference equaling the angle of arrival. However the angle of arrival that is determined in this matter is dependent upon the polarization of the incoming signal and can be off by as much as 90°.

In order to compensate for the polarization of the incoming signal, the antenna is electrically rotated to resolve the polarization ambiguity, with sampling of the four elements providing the ability to rotate the antenna to eight different directions. This electronic rotating of the antennas generates data that is used to cancel the polarization-dependent anomalies.

To compensate for the polarization anomalies the complex difference in amplitude between pairs of antenna elements in each of these eight directions is measured. This results in a correction factor that is applied to the angle of arrival information in each of these directions to cancel out the polarization induced ambiguity due to the polarization of the incoming signal. Thus, whether the incoming signal is right hand circularly polarized, left hand circularly polarized, linearly polarized or elliptically polarized, it makes no difference.

More particularly, taking various measurements from the four antenna elements permits determining the bearing or angle of arrival.

How this is accomplished is as follows. One multiplies the received right hand circular polarized signal with the left hand circular polarized signal to obtain a reference. One detects the phase difference between the left hand circularized polarized signal or the right hand circularized signal and the reference to obtain azimuthal bearing. Preferably, one uses a weighted average of the azimuthal bearings. However, these bearings are polarization-dependent.

In order to obtain an angle of arrival correction factor, one measures the complex (real and imaginary) amplitude difference between rotating pairs of antenna elements that in effect forms dipoles. Pairs of these elements are electronically rotated by selective sampling to arrive at an amplitude difference between the rotating pairs of elements for each of eight directions in one embodiment. The reference is RHCP× LHCP.

One then creates a plot of the real and imaginary components as a function of the direction (θ) of the rotating pairs. Next one finds a least square fit to the above functions using the basis function $$BF=E(\mathrm{SIN}(\theta))+\mathrm{COS}(\theta). \qquad \text{Eq. (1)}$$

The result is a solution for E where E is a complex number with real and imaginary parts.

The value of E is then inserted into the function $$F=(1+kiE)/(1+E^2) \text{ where } i=\sqrt{-1} \text{ and } k=+1 \text{ for AOA (RH) or } -1 \text{ for AOA(LH)} \qquad \text{Eq. (2)}$$

The above function is decomposed into the amplitude and phase representation of a complex number. The phase angle of F is the correction to the azimuthal AOA function previously described, ie.

AOA=phase difference between RHCP and REF or RHCP and REF Eq. (3)

For the case of a vertically polarized signal incident at 0 degrees the plot takes on the form of a COS θ plot. The value of E is found to be zero for this case.

If E is inserted into Eq. (2), F is found to be 1. The phase angle of one is 0. Thus the correction to the AOA is 0. In general for an arbitrary polarization (elliptical) E has real and imaginary parts and upon insertion into Eq. (2), F yields a non zero phase angle.

As to elevation, an estimate of the elevation AOA is derived by looking at the complex amplitude difference between the rotating pair which is closest to the estimated azimuthal AOA.

If the phase angle of this complex amplitude is Φ, then the cosine of the elevation AOA is equal to Φ times the wavelength divided by 2 times pi times the element spacing, ie.

$$\mathrm{COS}(el_{AOA})=\Phi\times\lambda/(2\pi\times\text{element spacing}) \quad \text{Eq. (4)}$$

In summary, polarization-independent bearing measurements are provided by a miniature conformal antenna having quadrature elements and a direction finding algorithm that utilizes circular polarization components of the incoming signal to derive angle of arrival. The measurements are corrected for polarization-dependent ambiguities by electronic antenna rotation and data obtained during rotation.

BRIEF DESCRIPTION OF THE DRAWINGS

These and other features of the subject invention will be better understood in connection with the Detailed Description, in conjunction with the Drawings, of which:

FIG. 8 is a diagrammatic illustration of the equations useful in providing for an average angle of arrival corrected for polarization anomalies.

DETAILED DESCRIPTION

Figure 1:
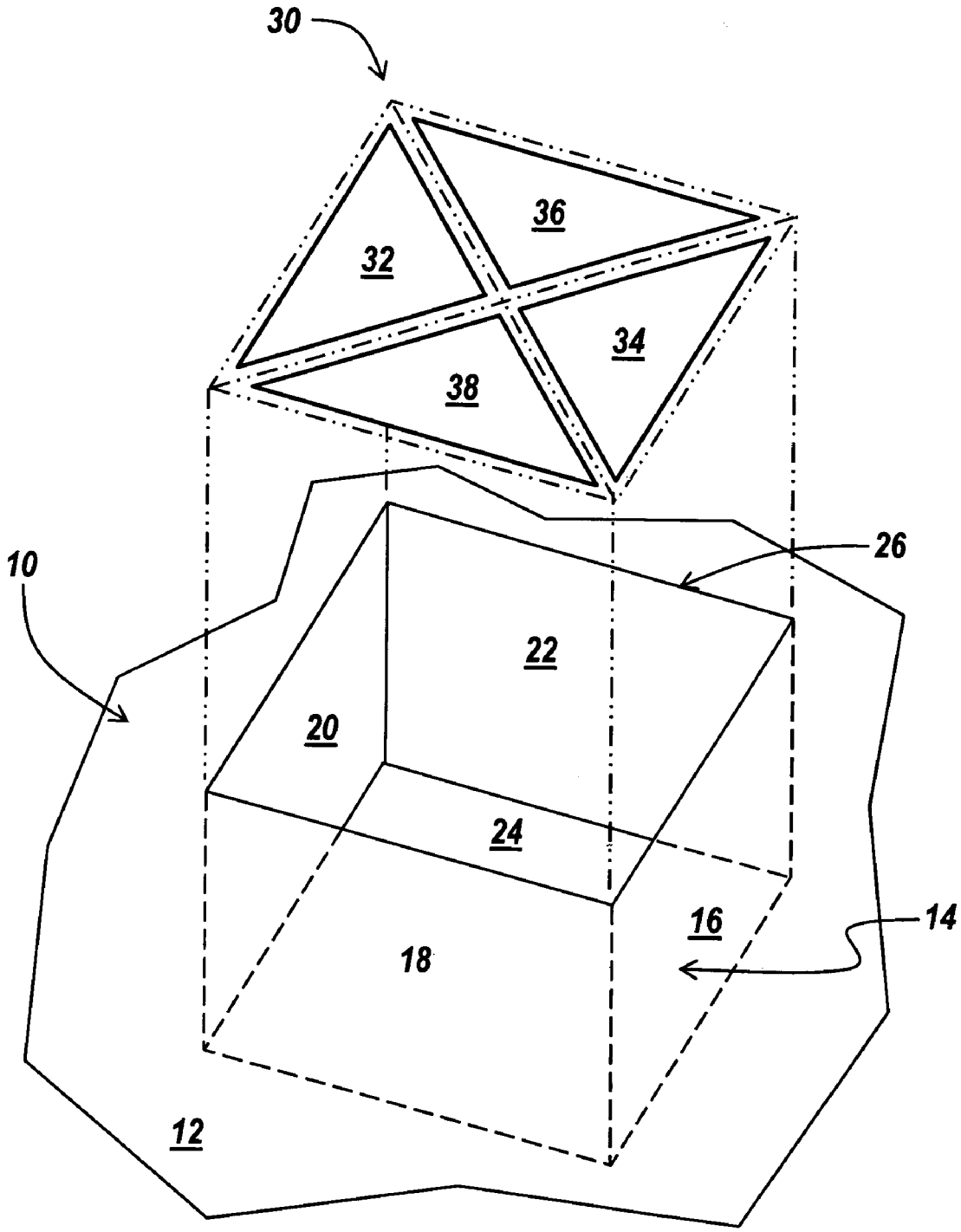
FIG. 1 is a diagrammatic illustration of a low visibility cavity embedded antenna having quadrature elements located at the mouth of the cavity.

Referring now to FIG. 1, a conformal antenna 10 is embedded in a ground plane sheet 12 having a cavity 14 which extends from the surface of sheet 12 down into the sheet. The cavity has conductive sides 16, 18, 20 and 22; and a conductive bottom 24. Disposed in the mouth 26 of cavity 14 are quadrature elements 30 which in one embodiment are in the form of opposed triangular elements 32 and 34 or 36 and 38.

Figure 2:
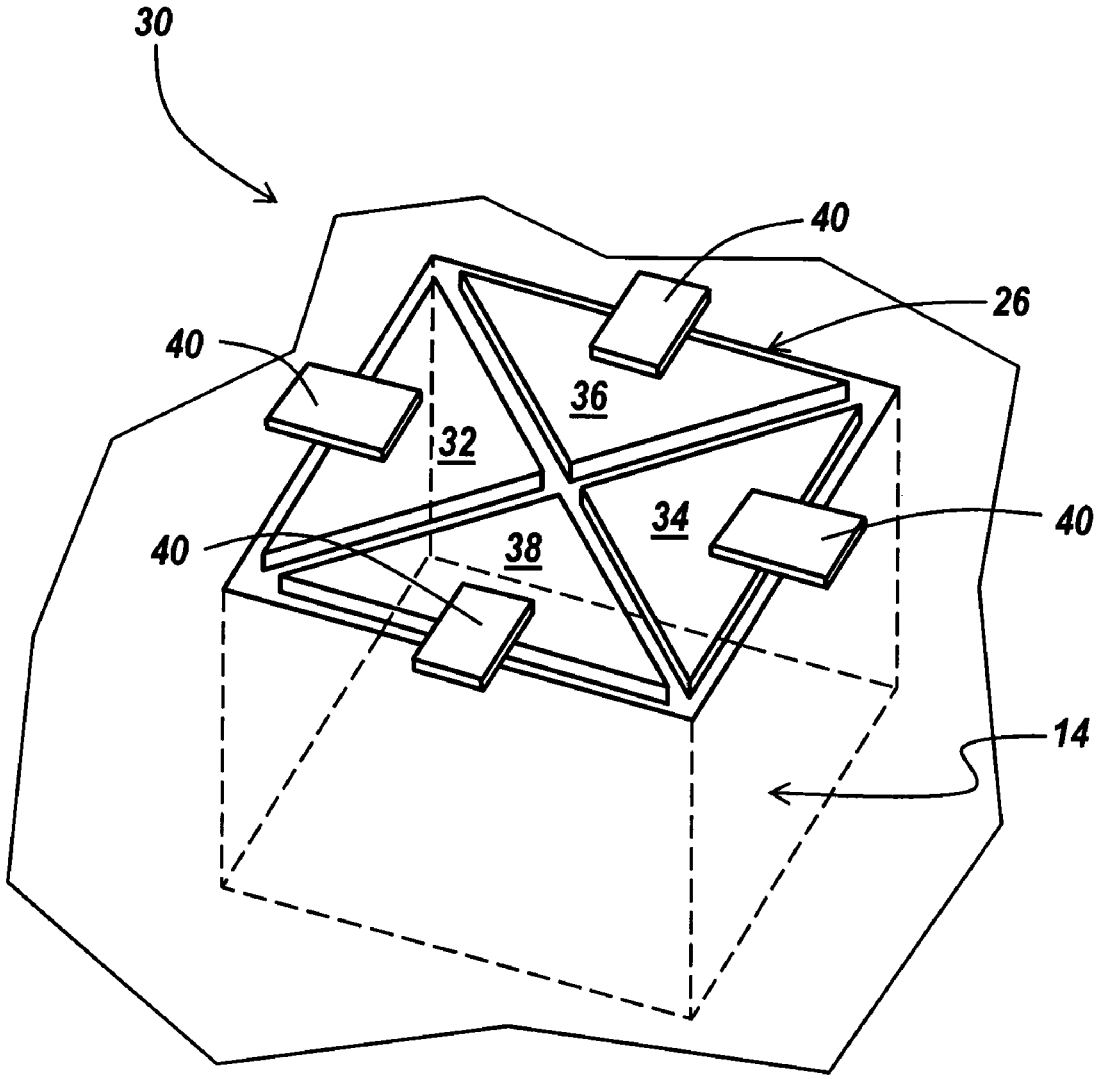
FIG. 2 is a diagrammatic illustration of the antenna of FIG. 1 illustrating the triangular shaped quadrature elements at the mouth of the cavity, also showing tuning stubs.

This quadrature array as illustrated in FIG. 2 is positioned at the mouth 26 of cavity 14, with the individual elements spaced from each other and in one embodiment mounted on an insulating substrate (not shown). Impedance matching elements 40 adjust antenna impedance.

It will be seen that the antenna described is a low visibility antenna and is miniaturized so as to not extend beyond the dimensions of mouth 26 of cavity 14. In one embodiment the cube formed by the cavity is seven inches on a side.

Figure 3:
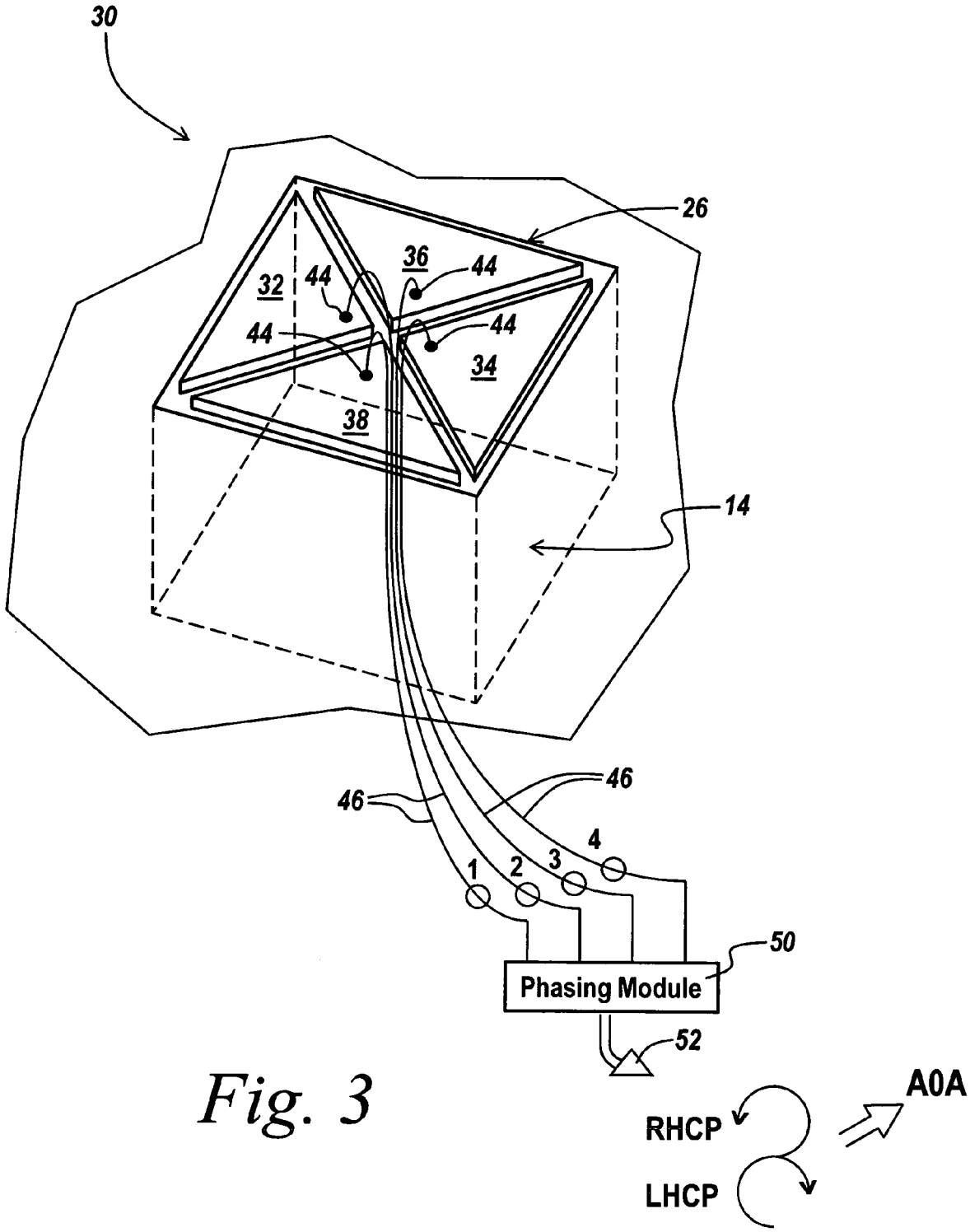
FIG. 3 is a diagrammatic illustration of the antenna of FIG. 2 illustrating the feed of the apexes of the antenna elements in FIG. 2, showing a phasing module which through analysis of right hand circular polarization and left hand circular polarization provides for the angle of arrival of an incoming signal.

Referring now to FIG. 3, the miniature conformal antenna, here illustrated at 42, is provided with the aforementioned elements 30, here labeled by Nos. 1, 2, 3 and 4. Each of these elements has a feed point at its apex, here illustrated at 44, with respective lines 46 running out of the bottom of the antenna and to a phasing module 50. In one embodiment these lines are coaxial lines with the outer braids unconnected but with the inner conductors connected between the feed points and the phasing module. The output of phasing module 50 is shown by arrow 52 to comprise right hand circular polarized and left hand circular polarized components of the signal or wave arriving at antenna 42. As will be shown, taking the right hand circularly polarized and left hand circularly polarized components, one can derive angle of arrival in a rather simple manner.

Figure 4:
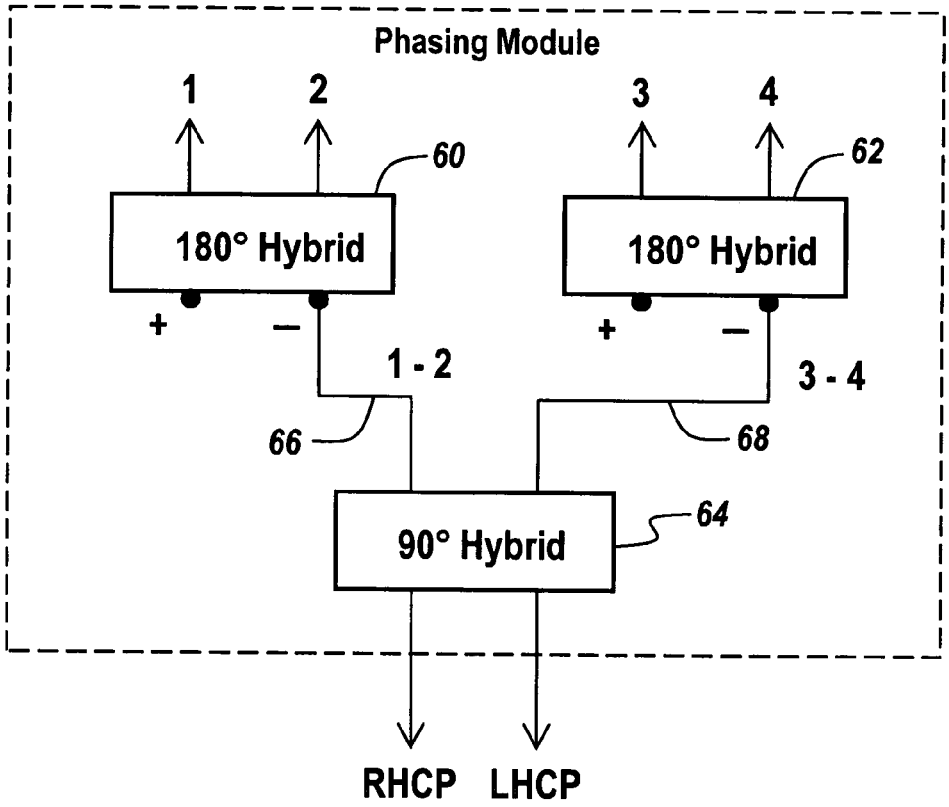
FIG. 4 is a diagrammatic illustration of an analog network utilizable in the phasing module of FIG. 3, illustrating the utilization of a pair of 180 degree hybrids coupled to a 90 degree hybrid out of which right hand circular polarization and left hand circular polarization components are available, also indicating the derivation of azimuthal bearing in which the phase difference between the left hand circular polarized signal component or the right hand circular polarized signal component and a reference signal yields angle of arrival.

Referring now to FIG. 4, how the right hand circularly polarized and left hand circularly polarized components of the incoming signal can be derived can involve the utilization of a first 180 degree hybrid 60 which has its output connected to lines 1 and 2 of FIG. 3, whereas a second 180 degree hybrid 62 has its output connected to lines 3 and 4 of FIG. 3.

The negative inputs to the hybrids are fed by a 90 degree hybrid 64 such that as far as antenna elements 1 and 2 are concerned, the output of hybrid 64 on line 66 feeds the input to hybrid 60, whereas line 68 feeds the input to hybrid 62.

The right hand circularly polarized and left hand circularly polarized components are outputted from hybrid 64 to generate bearing or angle of arrival, at least in the azimuthal direction. Thus, the bearing is a function of the right hand circularly polarized components and the left hand circularly polarized components derivable from hybrid 64.

In order to obtain the angle of arrival or azimuthal bearing, the right hand circularly polarized component is multiplied by the left hand circularly polarized component to provide a reference. The azimuthal bearing angle is the phase difference between the left hand circularly polarized component and the reference or the right hand circularly polarized component and the reference.

It is noted that one requires a weighted average to correct a situation when one for instance has a right hand circular polarized signal, but only utilizes a left hand circularly polarized component phase difference between the reference to derive angle of arrival. The following weighting eliminates this possibility. The difference in the phase angle between the circularly polarized components and their references are combined using a weighted average. The weighted average is achieved by multiplying the difference between the circularly polarized component and the reference by the absolute magnitude of the circularly polarized component. Then these left hand circularly polarized and right hand circularly polarized terms are divided by the sum of the two magnitudes mentioned above.

If the signal is left hand circularly polarized, then the coefficient that corresponds to the right hand circularly polarized component equals zero. Thus, one is left with one term for which angle of arrival can be derived. The corresponding is true for the reverse situation.

Figure 5:
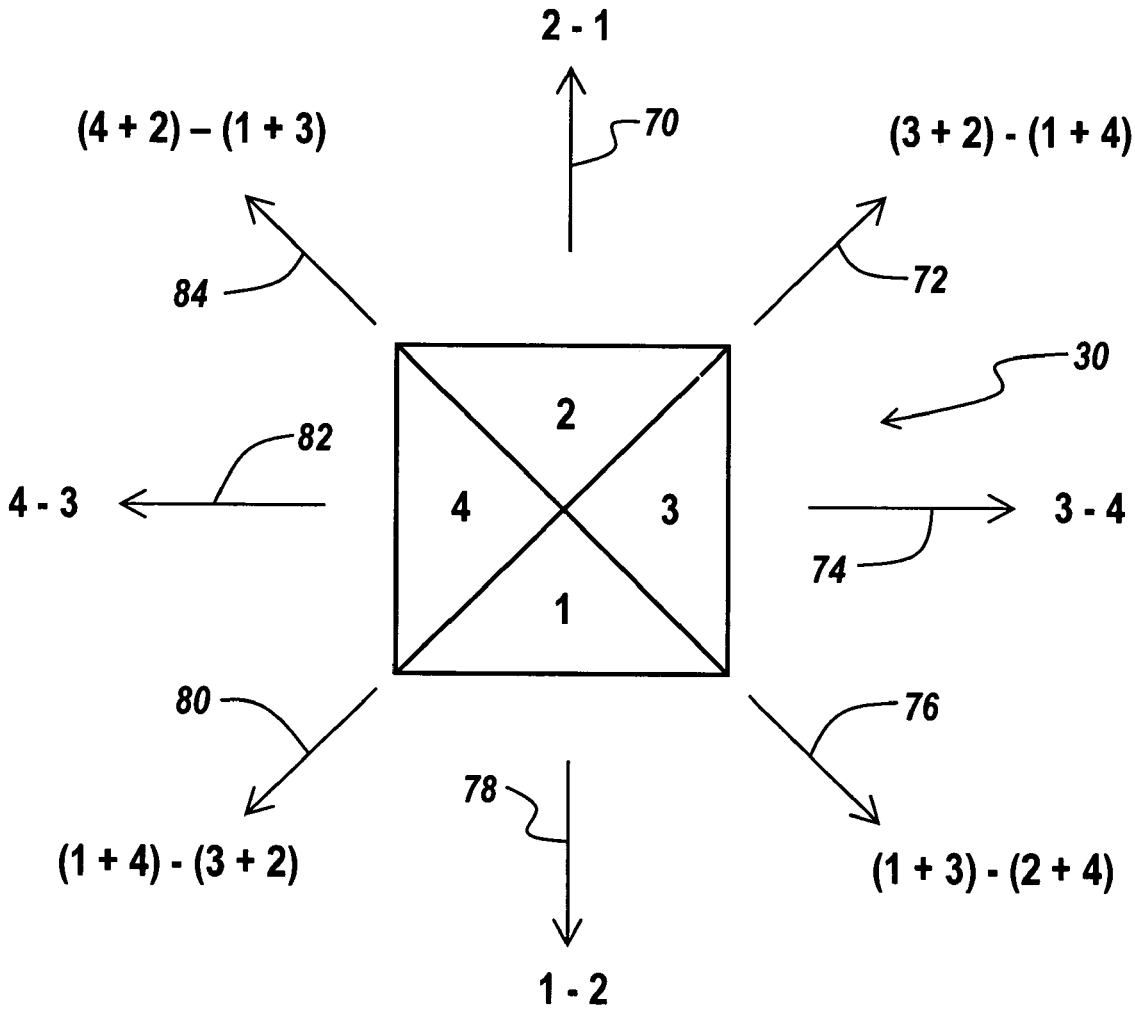
FIG. 5 is a diagrammatic illustration of the quadrature elements of the antenna of FIGS. 1, 2 and 3 illustrating that through sequential addressing of the feeds of the elements one can rotate the antenna to one of eight directions.
Figure 6:
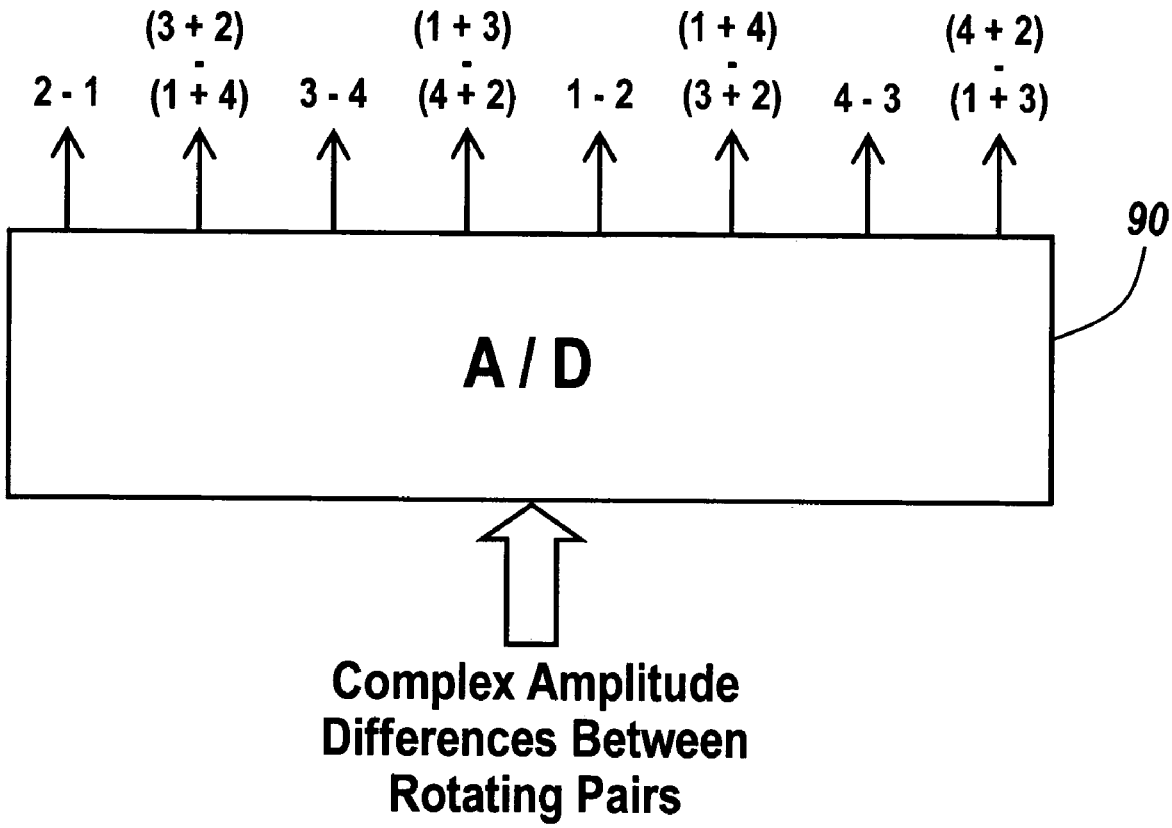
FIG. 6 is a diagrammatic illustration of the phasing module for electrically rotating the antenna of FIG. 5 utilizing an analog-to-digital converter to output the phase difference between rotating pairs of elements.

In order to make the conformal miniature antenna polarization-independent, one electrically rotates the effective direction of the antenna, as illustrated in FIG. 5, such that the elements 30, when addressed in a predetermined manner, provide for the effective direction of the antenna being, for instance at 0 degrees as illustrated by the vertical arrow 70, at 45 degrees as indicated by arrow 72, at 90 degrees as indicated by arrow 74, at 135 degrees as indicated by arrow 76, at 180 degrees as indicated by arrow 78, at 225 degrees as indicated by arrow 80, at 270 degrees as indicated by arrow 82, and at 350 degrees as indicated by arrow 84.

The phasing network in one embodiment takes the form of an analog-to-digital converter 90. This analog-to-digital converter establishes the 0 degree angle is done by subtracting the output of element 2 from that of element 1. Forty-five degrees is achieved by summing element 3 and element 4 and subtracting that from the sum of element 1 and element 4. For 90 degrees, one subtracts the output of element 3 from element 4, whereas for 135 degrees, one subtracts element 1 plus element 3 minus element 4 plus element 2. For 180 degrees, one subtracts element 1 from element 2, whereas for 225 degrees one adds element 1 and element 4 together and subtracts it from the sum of element 3 plus element 2. For 270 degrees, one subtracts elements 4 from element 3, whereas for 315 degrees one adds element 4 plus element 2 and subtracts from that element 1 plus element 3.

As will be seen one can obtain the amplitude difference between various pairs of elements as a function of angle utilizing sampling and the analog-to-digital converter.

The result is to be able to obtain signals representing the real and imaginary amplitude difference between pairs of the elements. Thus, one obtains the amplitude difference between rotating pairs of elements at various angles of arrival.

Figure 7:
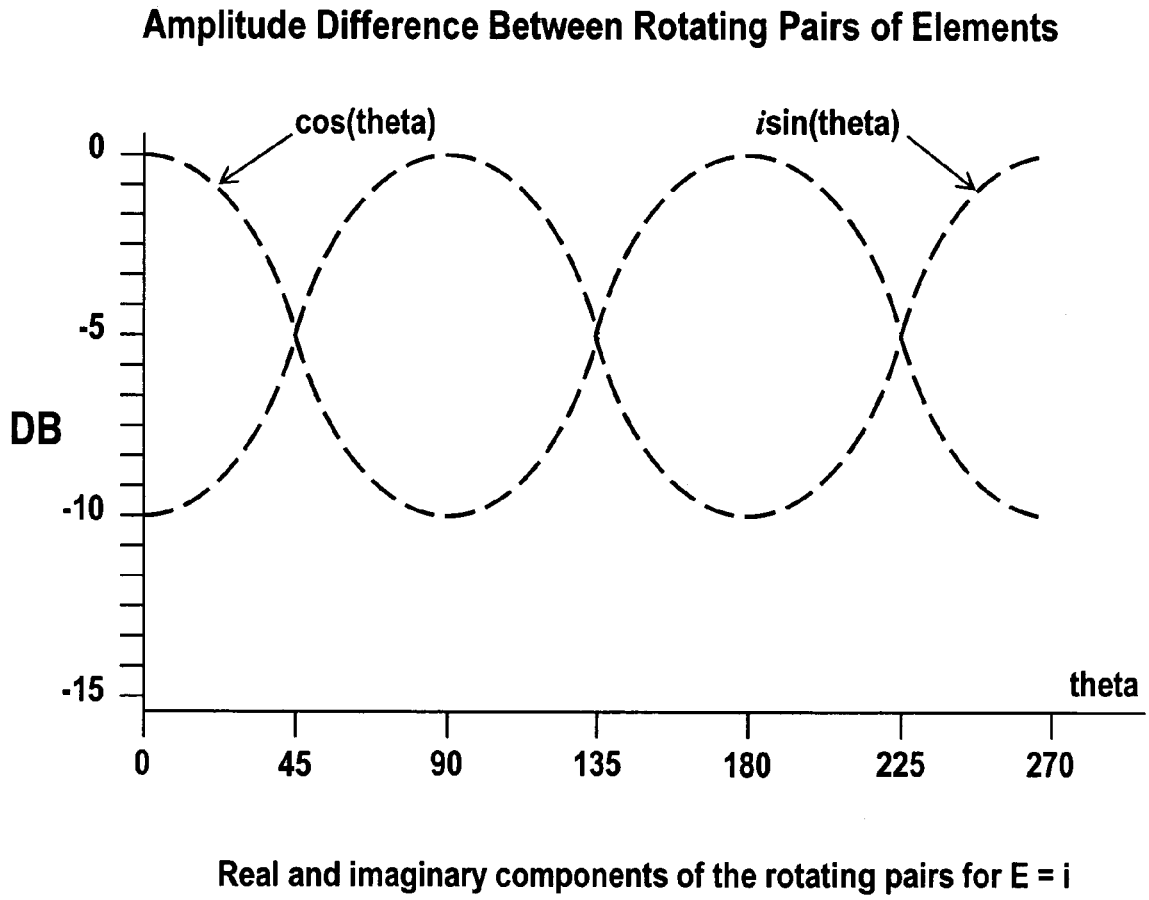
FIG. 7 is a graph showing the real and imaginary components of the amplitude difference between rotating pairs of elements for the various angles of arrival.

The amplitude difference curve in terms of real and imaginary components is illustrated in FIG. 7.

As mentioned hereinbefore, one can derive a least square fit for the curves of FIG. 7 as a function of angle for the rotating pairs, where the result is a solution for E, where E is a complex number with real and imaginary parts.

Having a least square fit, one can obtain the value of F of equation 2, with the phase angle associated with F being added to the azimuthal angle of arrival to compensate for polarization anomalies.

For the case of a vertically polarized signal incident at 0 degrees, which is the case illustrated in FIG. 7, the amplitude difference is a COS θ plot. The value of the E is found to be 0 for this case.

As mentioned above, if E is inserted in Equation 2, F is found to be one, and the phase angle of 1 is 0. Thus, the correction for the angle of arrival is 0.

For other polarized signals at other angles of incidences, F yields a non-zero phase angle which, when added to the phase angle derived from Equation 3 provides a relatively simple polarization-independent method of ascertaining azimuthal angle of arrival.

Thus, referring to FIG. 8, by utilizing right hand circular polarized and left hand circularly polarized components of an incoming signal as derived in various directions based on the addressing of the elements of the antenna, one can derive from left hand circularly polarized and right hand circularly polarized components, a polarization-dependent average angle of arrival. This azimuthal angle of arrival is then corrected by the phase angle α associated with F which is added to an uncorrected angle of arrival as illustrated in the equations of FIG. 8 to yield a corrected average polarization-independent angle of arrival.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A miniature conformal polarization-independent antenna, comprising:

a cavity having a mouth and located in a conductive substrate;

quadrature antenna elements at the mount of said cavity;

a phasing module coupled to the feed points of said elements for measuring the right hand circular polarized component and the left hand circular polarized component of a signal at said antenna; and, a unit within said module for calculating the angle of arrival of a wave incident on said antenna by measuring the right hand circularly polarized components and the left hand circularly polarized components of the wave and for generating an angular correction factor compensating for the polarization of the incoming wave, the angular correction factor being derived from the right hand circularly polarized components and the left hand circularly polarized components of the wave incident on said antenna and the electronic rotation of said antenna, said angular correction factor being a function of the complex amplitude difference in the outputs of pairs of said antenna elements.

2. The antenna of claim 1, wherein said angular correction factor is derived from a plot of said amplitude difference as a function of angle.

3. The antenna of claim 2, wherein said angular correction factor is derived from curve fitting with said plot.

4. The antenna of claim 3, wherein a correction factor F is derived from said curve fitting.

5. The antenna of claim 4, wherein said angular correction factor is a phase angle associated with F.

6. The antenna of claim 1, wherein said quadrature antenna elements are triangular in shape.

7. The antenna of claim 6, wherein said triangular elements are fed at the apex of the element.

8. The antenna of claim 7, wherein opposed pairs of said triangular elements form dipoles, and wherein the direction associated with said antenna is determined by addressing selected dipoles and processing the outputs therefrom.

9. A method for compensating a cavity embedded conformal antenna having quadrature elements at the mouth of the cavity so as to provide a polarization-independent angle of arrival and measurements, comprising the steps of:

obtaining angle of arrival from measured right hand circularly polarized and left hand circularly polarized components of a wave incident on the antenna; and, correcting the angle of arrival to remove polarization-dependent anomalies, the correcting step including the step of electronically rotating the direction which the antenna is sensitive to and addressing and processing selected antenna elements, the antenna being sampled at a number of different directions to form an amplitude difference between pairs of elements and selected angles of arrival to the antenna so as to form a curve, the correcting step including utilizing the curve for deriving a correction factor to remove polarization-dependent anomalies.

10. The method of claim 9 and further including deriving elevation utilizing the outputs of the elements.

11. A low visibility miniature conformal polarization-independent antenna, comprising:

a cavity imbedded antenna having quadrature elements, pairs of which form dipoles; and a phasing module coupled to said antenna elements for deriving angle of arrival from right hand circularly polarized and left hand circularly polarized components of a signal incident on said antenna and for correcting polarization-induced errors by using the right hand circularly polarized components and the left hand circularly polarized components from said elements and electronic antenna rotation to provide an angular correction so that the azimuthal angle of arrival determined by the right hand circularly polarized components and left hand circularly polarized components has polarization-induced errors removed, said angular correction being a function of the complex amplitude difference in the outputs of pairs of said antenna elements.

* * * * *